US006619509B2

(12) United States Patent
DeKoning et al.

(10) Patent No.: US 6,619,509 B2
(45) Date of Patent: Sep. 16, 2003

(54) LIQUID DISPENSER

(75) Inventors: Paul W. DeKoning, Portland, OR (US); Dave Knaub, Portland, OR (US)

(73) Assignee: The Dial Corporation, Scottsdale, AZ (US)

( * ) Notice: Subject to any disclaimer, the term of this patent is extended or adjusted under 35 U.S.C. 154(b) by 0 days.

(21) Appl. No.: 09/828,723

(22) Filed: Apr. 9, 2001

(65) Prior Publication Data

US 2002/0005414 A1 Jan. 17, 2002

Related U.S. Application Data

(60) Provisional application No. 60/195,773, filed on Apr. 10, 2000.

(51) Int. Cl.[7] ..... B67D 5/06
(52) U.S. Cl. ..... 222/183; 222/214; 222/325
(58) Field of Search ..... 222/95, 105, 180, 222/181, 325, 183, 214, 181.3

(56) References Cited

U.S. PATENT DOCUMENTS

| | | | | | |
|---|---|---|---|---|---|
| 3,540,630 | A | * | 11/1970 | Brown et al. | 222/181.3 |
| 4,164,306 | A | * | 8/1979 | Perrin | 222/181 |
| 4,166,553 | A | * | 9/1979 | Fraterrigo | 222/181 |
| 4,429,812 | A | * | 2/1984 | Steiner et al. | 222/181 |
| 4,673,109 | A | * | 6/1987 | Cassia | 222/214 |
| 4,886,192 | A | * | 12/1989 | Cassia | 222/181 |
| D312,184 | S | | 11/1990 | De Luca et al. | |
| D316,498 | S | | 4/1991 | Barry | |
| 5,016,779 | A | * | 5/1991 | Williamson | 222/95 |
| D332,544 | S | | 1/1993 | Steiner et al. | |
| D337,229 | S | | 7/1993 | Giugiaro | |
| 5,613,625 | A | * | 3/1997 | Specht | 222/180 |
| 5,632,418 | A | * | 5/1997 | Brown | 222/180 |
| D385,139 | S | | 10/1997 | Mervar et al. | |
| D401,093 | S | | 11/1998 | Arbak et al. | |
| D417,111 | S | | 11/1999 | Polan | |
| 5,992,698 | A | * | 11/1999 | Copeland et al. | 222/180 |
| D431,404 | S | | 10/2000 | Brazis et al. | |
| 6,247,621 | B1 | * | 6/2001 | Lewis | 222/183 |

* cited by examiner

*Primary Examiner*—Philippe Derakshani
(74) *Attorney, Agent, or Firm*—Snell & Wilmer LLP

(57) ABSTRACT

In accordance with various aspects of the present invention, a liquid dispensing apparatus having improved sanitary, aesthetics and stabilizing aspects is provided. For example, in accordance with one aspect of the present invention, liquid dispensing apparatus comprises a dispensing housing designed to contain a soap filled bottle. Depending on particular configurations, the housing may be designed as an open or closed system. In any case, the housing has a sleek, streamlined design with a dispensing button which tends to have a rounded appearance that accents the shape of the remainder of housing. In accordance with various other aspects of the present invention, within the housing is a stabilization system which prevents bottles which are not designed to engage housing from being inserted into housing. In addition to (or alternatively) housing may have support structure which allows the soap bottle to rest within housing with less of a propensity to wobble.

8 Claims, 5 Drawing Sheets

LIQUID DISPENSER

This application claims priority to U.S. Provisional Patent Application Serial No. 60/195,773 filed on Apr. 10, 2000.

BACKGROUND OF THE INVENTION

1. Technical Field of the Invention

This invention relates generally to liquid dispensing devices, and more particularly, to liquid soap dispensing devices.

2. Background of the Invention

Various liquid dispensing devices are known in the art. For example, commonly known dispensers are those used for distributing soap (e.g., hand soap) in public restrooms. The dispensers offer the benefits of convenience of use, easy refilling, refillable or disposable containers, and the like.

One example of common soap dispensers is the disposable pump and container system which generally comprises a plastic bottle with a pump which screws into a cap fitted to the bottle. Generally, these units are disposed of once empty. However, in some cases, the bottles may be refilled. Unfortunately, however, these dispensers are susceptible to being knocked over, stolen, or lost because, in general, they merely sit on countertops and in wash basin areas. Further, the containers tend to be of smaller and/or limited capacity.

Another common dispenser is the wall-mounted dispenser which is intended to provide a greater degree of security and reliability for public restrooms. Generally, this type of dispensing apparatus comprises a housing which is mounted on the wall of the restroom. The housing is open and inside a disposable or refillable container of liquid soap is placed within the housing. The housing is closed and a pumping means is used for distributing the soap to the user.

These types of dispensers are not without their drawbacks either. For example, they can be messy. That is, many dispensers have pump mechanisms which are awkward for the user. When a lever is pulled the soap is dispensed into the user's hand. However, this can cause soap to drip on the lever and other structures of the soap dispenser. Likewise, other push button type dispensers consist of elongated pumping members which also may become covered with liquid soap and may be prone to breaking. Still further, with many of these soap dispensers, sanitation can be a problem. That is, because the pumping mechanisms and ejection nozzles are integrated with the dispenser itself, they must be cleaned or replaced. Because they are integrated with the dispenser itself, it is often not easy to replace the pumping mechanism.

With existing soap dispensers it is also common for janitorial services to dispose of refill bottles before they are completely empty. For example, many janitorial services have prescheduled times that they check and clean the soap dispensers and the restrooms they are located in. If a soap dispenser bottle is nearly empty, often, to ensure that the dispenser does not run out of soap before the person refilling the dispenser returns, they will simply throw out the bottle, regardless of how much soap is left, and replace it with a full bottle. Thus, the potential for wasting soap is high.

Further, it is not uncommon to place soap bottle refills within soap dispenser housings which are not intended to fit within the housing being used. This leads to an insecure fit within the housing, potentially causing problems with dispensing, closing the housing, and wobble of the bottle within the housing.

Thus, improved soap dispenser housing units are desirable. In particular, units which are more sanitary, aesthetically pleasing, do no suffer from premature disposal of the refill bottles, and prevent wobble within the housing are desirable.

SUMMARY OF THE INVENTION

In accordance with various aspects of the present invention, a liquid dispensing apparatus having improved sanitary, aesthetics and stabilizing aspects is provided. For example, in accordance with one aspect of the present invention, liquid dispensing apparatus comprises a dispensing housing designed to contain a soap filled bottle. Depending on particular configurations, the housing may be designed as an open or closed system. In any case, the housing preferably has a sleek, streamlined design with a dispensing button which tends to have a rounded appearance that accents the shape of the remainder of the housing. Similarly, the housing has various aspects tending to create a symmetry between various views of the dispenser. In accordance with various other aspects of the present invention, within the housing is a stabilization system which prevents bottles which are not designed to engage housing from being inserted into housing. In addition to (or alternatively) housing may have support structure which allows the soap bottle to rest within housing with less of a propensity to wobble.

BRIEF DESCRIPTION OF THE DRAWING FIGURES

Additional aspects of the present invention should become evident upon reviewing the non-limiting embodiments described in the specification taken in conjunction with the accompanying figures, wherein like numerals designate like elements, and:

DETAILED DESCRIPTION OF EXEMPLARY EMBODIMENTS

The following descriptions are of exemplary embodiments of the invention only, and are not intended to limit the scope, applicability or configuration of the invention in any way. Rather, the following description is intended to provide a convenient illustration for implementing various embodiments of the invention. As will become apparent, various changes may be made in the function and arrangement of the elements described herein without departing from the spirit and scope of the invention. For example, though not specifically described, many shapes and orientations of the housing and refill bottle and alternative dispensing and pumping mechanisms should be understood to fall within the scope of the present invention.

In general, the present invention comprises a liquid dispensing unit 10 with a backing 11, a cover 12, and a bottle 30. Dispensing unit 10 is preferably comprised of a substantially rigid plastic such as high density polyethylene ("HDPE"), but any other suitable material rigid, semi-rigid or even flexible material may be used.

Figure 1:
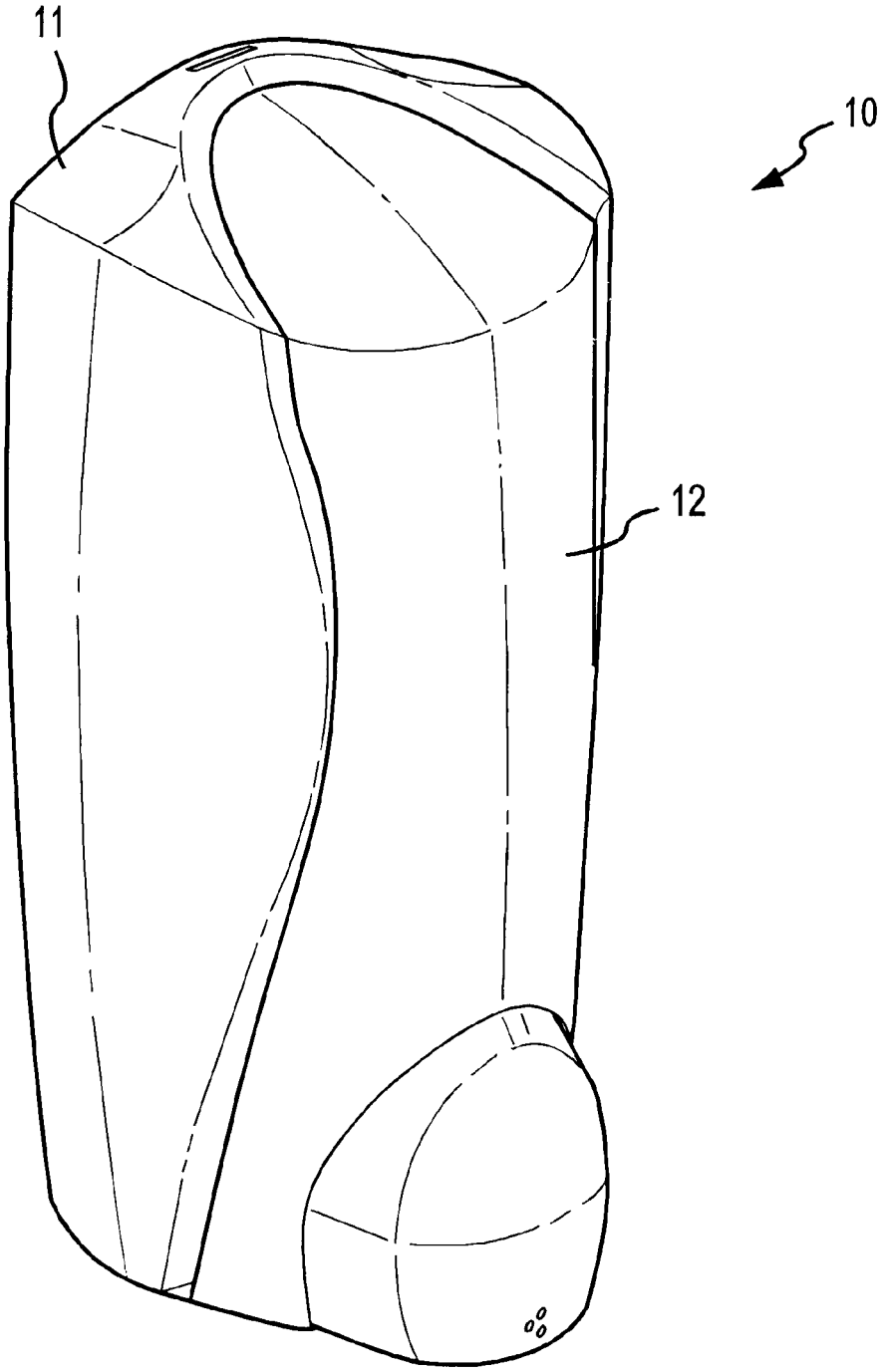
FIG. 1 is a top perspective view of a soap dispenser of the present invention.
Figure 2:
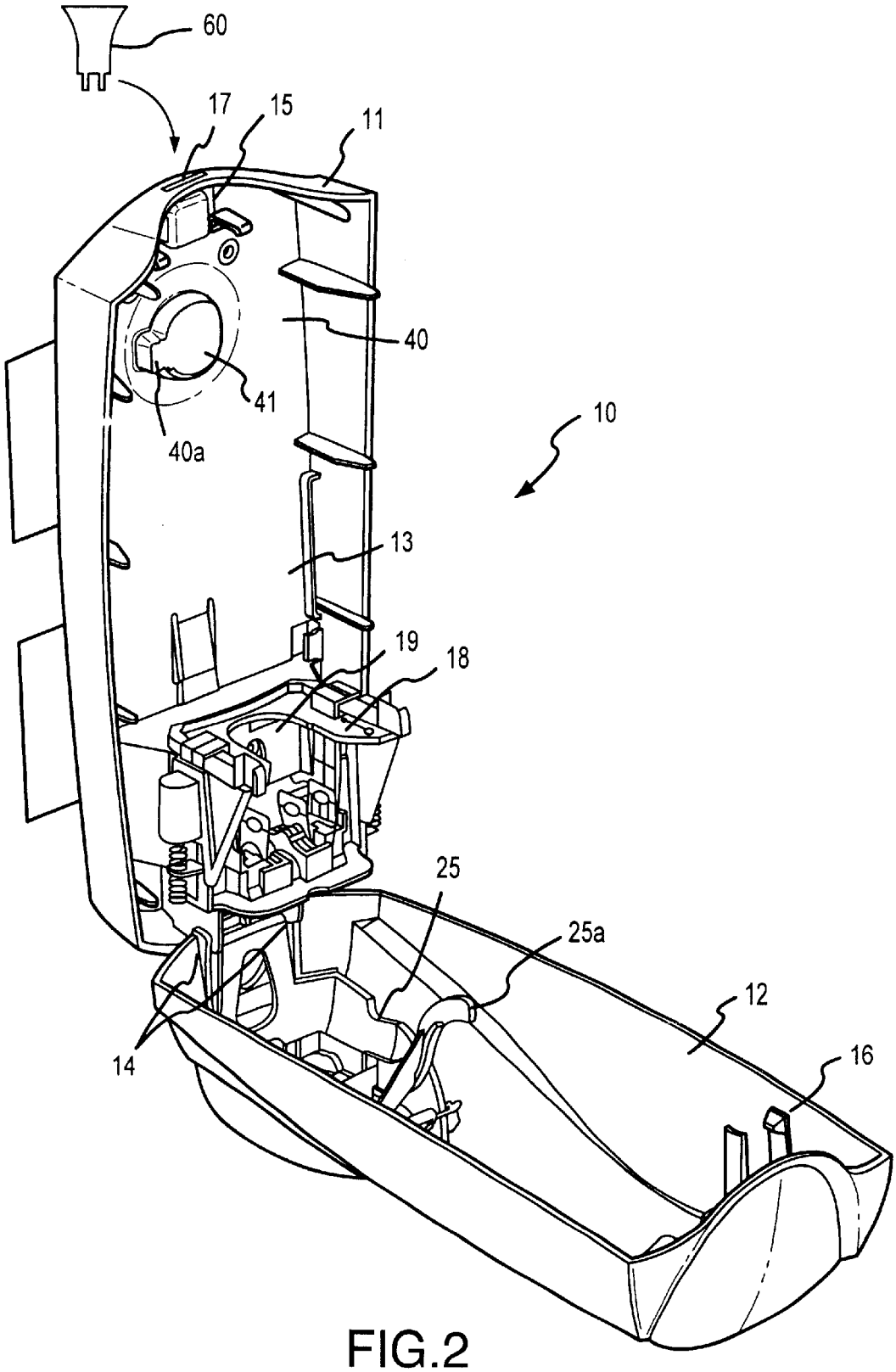
FIG. 2 is a top perspective view of an exemplary embodiment of a closed system soap dispenser of the present invention.

As can be seen with reference to FIGS. 1 and 2, in one exemplary embodiment, cover 12 is releasably attached to backing 11. As should be apparent, various configurations for attaching backing 11 and cover 12 may be employed, and generally allow for cover 12 to be opened such that a cavity 13 is accessible. In this embodiment, cover 12 is hingedly connected to backing 11 by hinges 14 so that cover 12 may be pivotally opened. Of course, in accordance with various alternative embodiments of the invention, cover 12 may be completely detachable, slidably releasable, or the like. Optionally, cover 12 or part of cover 12 may be comprised of a clear or translucent material to enable the user to view the contents of dispenser 10, for example, to aid in determining whether the unit needs to be refilled.

Further still, as mentioned above, in accordance with various embodiments of the present invention, cover 12 preferably has an aesthetically pleasing, sleek, design. For example, in the various embodiments described herein, cover 12 has a substantially longer vertical length than its width. Additionally, the corners of the housing, as well as the edges, tend to be of a rounded nature. Similarly, the dispensing button (which is configured to operate various pumping mechanisms) has similarly rounded features which tend to flow with remainder of cover 12. Thus, symmetry of the various features and views of unit 10 is created. Still further, for aesthetic reasons, the dispensing button and cover 12 (and likewise various other components of dispenser 10) may optionally be of varying colors.

In accordance with another aspect of dispenser 10, a locking mechanism is provided to secure cover 12 and back 11 in a closed position. Generally, any means of securing cover 12 and back 11 may be used, including snaps, adhesives, threadable connections and the like. In the presently described embodiment, locking mechanism comprises a reception 15 and corresponding teeth 16. In this embodiment, teeth 16 are located on cover 12 and reception 15 is located on backing 11, though it should be apparent the locations may be reversed. Teeth 16 preferably engage reception 15 in a snap fit manner to secure cover 12 and back 11. Preferably, back 11 has a keyhole 17 for disengaging cover 12 and back 11. In the present embodiment, to disengage locking mechanism, a key 60 is inserted into key holes 17. The key suitably extends teeth 16 away from reception 15 so that cover 12 may be pivoted away from back 11.

In accordance with another aspect of the present invention, a stabilizing mechanism is provided. Stabilizing mechanism suitably comprises any structure which prevents bottles of the wrong size to be placed in dispenser 10 and/or suitably provides support to the bottles inserted into dispenser 10 aiding in preventing movement of the bottle once inserted into dispenser 10 (rotation or "wobble"). For example, in accordance with one exemplary embodiment, stabilizing mechanism 40 comprises a projection 41 and a depression 50. In the present exemplary embodiment, and with reference to FIGS. 2, 4 and 5, projection 41 is a structure integrated into backing 11, and depression 50 is a cavity integrated into bottle 30 which corresponds to projection 41. Thus, projection 41 and depression 50 engage when bottle 30 is inserted into dispenser 10.

Figure 4:
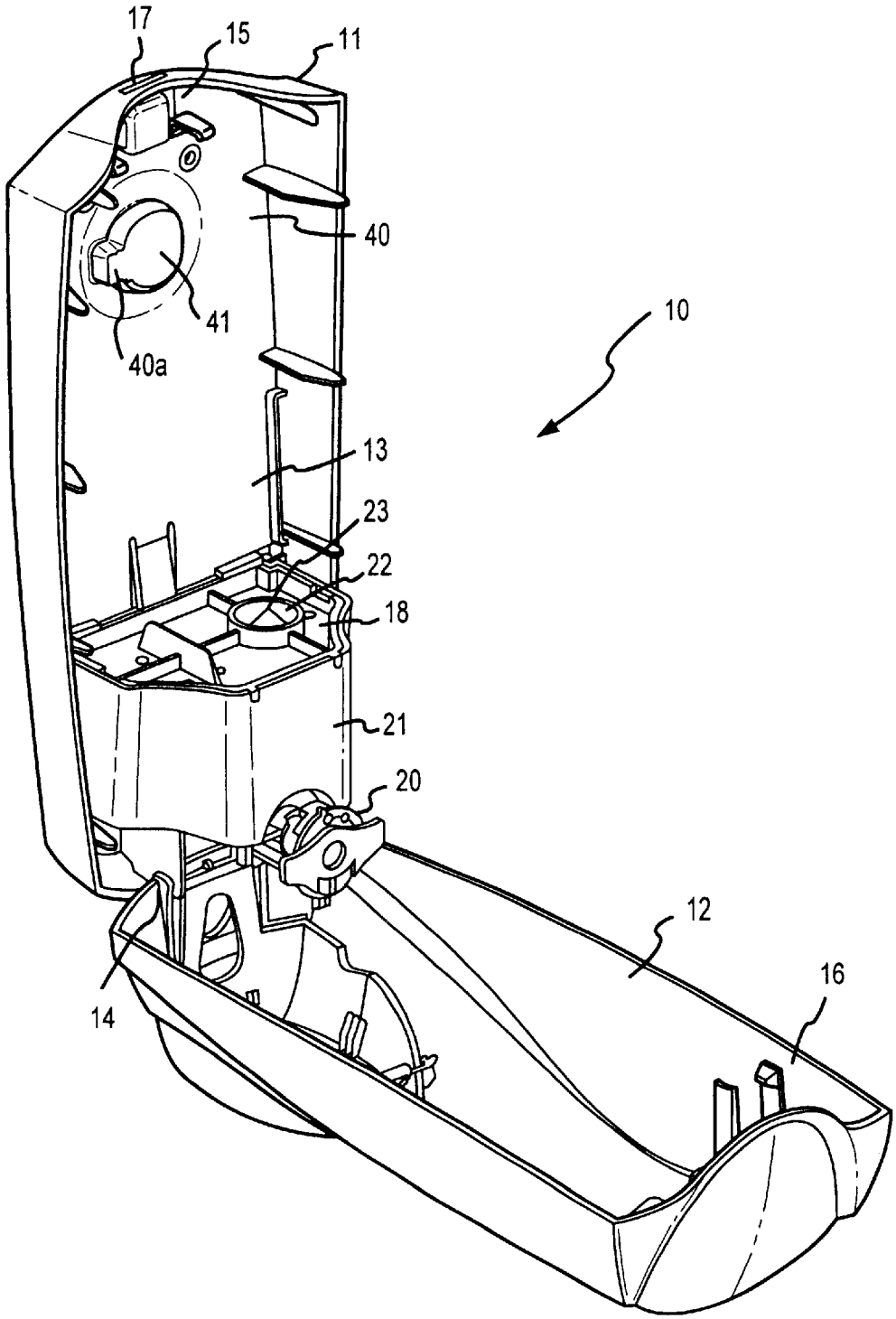
FIG. 4 is a top perspective view of an exemplary embodiment of an open system soap dispenser of the present invention.
Figure 5:
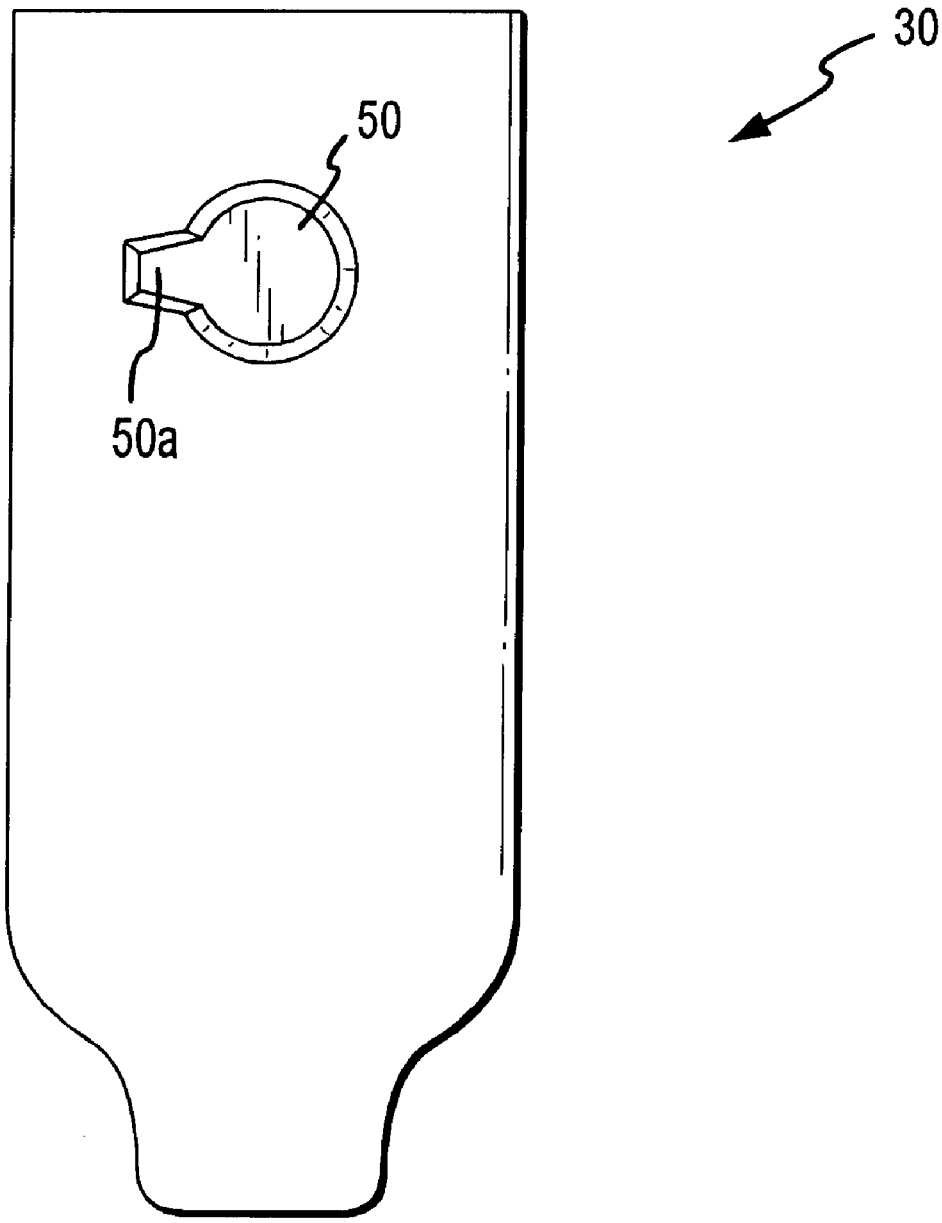
FIG. 5 is a back plan view of a bottle in accordance with the present invention.

Optionally, projection 41 may further comprise an anti-rotation protrusion **40*a* which aids in preventing rotational movement of bottle 30 within dispenser 10. For example, FIGS. 2 and 4 illustrate an exemplary embodiment of protrusion 40*a* configured as a notch-like projection. Similarly, depression 50 may further comprise an anti-rotation indention 50*a* which aids in preventing rotational movement of bottle 30 within dispenser 10. For example, FIG. 5 illustrates an exemplary embodiment of indention 50*a* configured as a notch-like depression which substantially corresponds to protrusion 40*a***.

Of course, it should be apparent that in alternative embodiments, varying numbers and configurations of projections and depressions 41, 50 may be used. For example, projection 41 and depression 50 may take on varying shapes so that bottle 30 cannot rotate within housing and likewise to correspond particular bottles 30 to particular dispensers 10. Similarly, the shape of projection/depression 41, 50 may indicate the manufacture of dispenser 10. Further, projection 41 can be located on bottle 30, and depression 50 can be located on the housing including, for example, backing 11 and cover 12.

Stabilization system may also comprise (or alternatively comprise) support structure for supporting bottle 30 within dispenser 10. For example, on back plate 11, support structure 18 is provided so that a liquid dispensing bottle can be placed in cavity 13 such that bottle 30 is supported within cavity 13. In the presently described embodiment, support structure 18 is provided on backing 11 to support bottle 30 once it is placed within cavity 13 of dispenser 10. In the embodiment of FIG. 2, support structure 18 suitably comprises a plate with a neck depression 19 configured to surround the neck of bottle 30 such that bottle 30 is secured within cavity 13. In the present embodiment, in a system where soap is distributed to the user directly from bottle 30 or a "closed system," support structure 18 is located proximate to the lower portion of cavity 13 near the base of unit 10.

With reference to FIG. 2, in accordance with the present exemplary embodiment, support structure 18 for a closed liquid dispensing system comprises a rigid shelf-like structure projecting from back plate 11. Of course, in accordance with alternative embodiments, support structure 18 may comprise any alternative structure which suitably provides support to bottle 30 when placed in cavity 13. For example, multiple projections which need not be integrated with back plate 11 may be used. Likewise, support straps which encircle the bottle, snap in locking mechanisms and other support structure such as substantially vertical members which support the sides of the bottle may be used.

Figure 3:
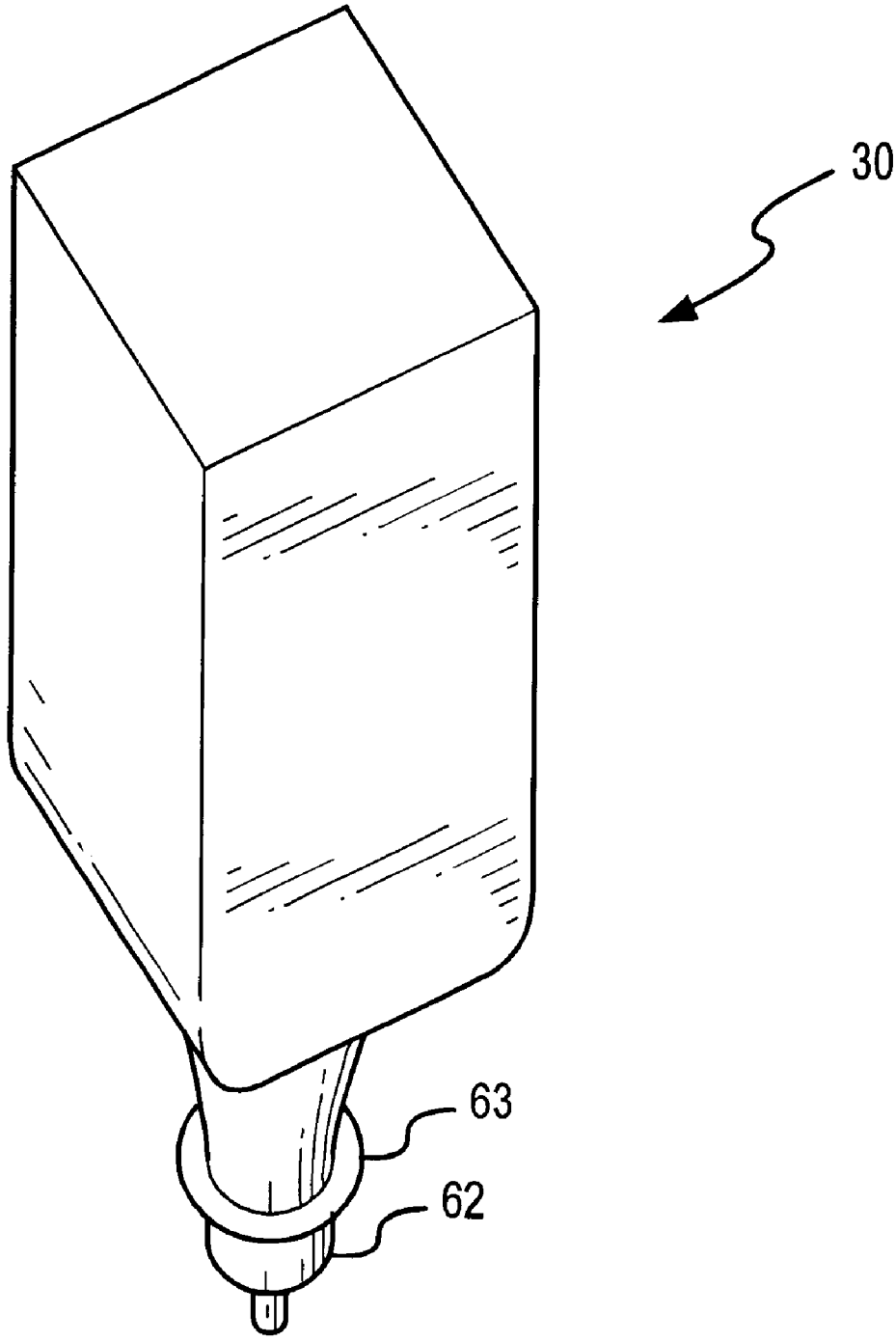
FIG. 3 is a top perspective view of an open or closed system bottle of the present invention.

Generally, with reference to FIG. 3, in a closed system, bottle 30 contains its own dispensing nozzle 62 for regulating disbursement of the contents of bottle 30. As mentioned above, a closed system allows for disbursement of the liquid in the bottle to be dispensed directly from bottle 30 to the user. When a pumping mechanism 25 integrated with dispenser 10 is activated, pumping mechanism 25 interacts with nozzle 62 to dispense soap to the user. For example, in this closed system embodiment, when pumping mechanism 25 is pressed inward by the user, a pumping member **25*a* extends a collar 63 on bottle 30 in a downward direction to dispense soap to the user. When deactivated, collar 63** returns to its original position and soap is not dispensed.

Now, in accordance with but one alternative embodiment of the present invention, dispenser 10 comprises a system where the soap leaves bottle 30 and is transferred to a compartment of unit 10 prior to disbursement of the user or an "open system." With combined reference to FIGS. 3 and 4, bottle 30 generally contains a neck with a nozzle configured to engage an open system pumping mechanism 20. In the open dispenser 10, the liquid to be dispensed leaves the bottle and fills a containment unit 21 prior to disbursement to the user. With reference now to FIG. 4, an exemplary open system is illustrated. In accordance with this embodiment, a reservoir 21 is provided. In this embodiment, reservoir 21 is suitably integrated with support structure 18 and pumping mechanism 20. When dispenser 10 is open, bottle 30 can be placed upon support structure 18 located directly above reservoir 21. An opening 22 is provided on reservoir 21. Opening 22 suitably comprises a piercing mechanism 23 surrounded by a plurality of holes to allow soap to drain into reservoir 21. In accordance with the present embodiment, piercing mechanism 23 suitably pierces the foil over the opening of bottle 30 (to prevent leakage prior to use) so that soap may be dispensed from bottle 30. The holes suitably allow soap to be dispensed into reservoir 21 and/or likewise allow air to return to bottle 30 as soap is dispensed. Thus, when bottle 30 is placed in cavity 13 and foil is pierced by piercing mechanism 23, soap flows into reservoir 21. Thus, during use, a user operates pumping mechanism 20 which pumps the liquid (soap) directly from reservoir 21 to the user.

Thus, it should be apparent that many alterations of the dispenser embodiments described herein may be made. For example, as mentioned above, open and closed systems may be interchanged. That is, reservoir 21 may be suitably configured to fit the structure which comprises a closed system. Further, many drawbacks of the prior art are solved. For example, with reference to the closed system, pumping mechanisms and nozzles do not become messy or unsanitary.

Lastly, various aspects of the invention have been described in illustrative embodiments. Of course, many combinations and modifications of the above-described structures, arrangements, proportions, elements, materials and components, used in the practice of the invention, in addition to those not specifically described, may be varied and particularly adapted to specific environments and operating requirements without departing from those principles.

We claim:

1. A liquid dispensing apparatus, comprising:

a bottle;

a housing having a backing; and a stabilization system for supporting said bottle within said housing, said stabilization system comprises:

a circular projection on said backing, said projection having an anti-rotation notch shaped protrusion; and a depression on said bottle, said depression having an anti-rotation indention corresponding to said anti-rotation protrusion, wherein said projection and said depression engage when said bottle is inserted into said housing.

2. A liquid dispensing apparatus in accordance with claim 1, wherein said housing further comprises said backing and a cover, wherein said cover has a vertical length at least about three times longer than a width of said cover.

3. A liquid dispensing apparatus in accordance with claim 2, further comprising a button on said cover having substantially rounded features.

4. A liquid dispensing apparatus in accordance with claim 1, wherein said stabilization system further comprises a support structure upon which said bottle rests upon insertion into said housing.

5. A liquid dispensing apparatus in accordance with claim 1, wherein the liquid dispensing system is an open system.

6. A liquid dispensing apparatus in accordance with claim 5, further comprising a reservoir for retaining soap dispensed from said bottle prior to disbursement of said soap to a user of the dispensing system.

7. A liquid dispensing apparatus in accordance with claim 6, wherein said reservoir has an opening with a piercing mechanism.

8. A liquid dispensing apparatus in accordance with claim 1, wherein the liquid dispensing system is a closed system.

* * * * *